United States Patent [19]

Fracaro

[11] 4,438,728

[45] Mar. 27, 1984

[54] MULTI-STAGE HOT WATER HEATING APPARATUS

[76] Inventor: Eugene E. Fracaro, 533 E. 11th St., Lockport, Ill. 60441

[21] Appl. No.: 220,742

[22] Filed: Dec. 29, 1980

[51] Int. Cl.[3] ..... F22B 5/00

[52] U.S. Cl. ..... 122/14; 122/16; 122/17; 122/19; 126/361; 126/362

[58] Field of Search ..... 122/14, 17, 18, 19, 122/52, 123, 160, 161, 448 B, 16; 126/361, 362

[56] References Cited

U.S. PATENT DOCUMENTS

| | | | |
|---|---|---|---|
| 707,107 | 8/1905 | Haarmann | 122/52 |
| 1,961,723 | 6/1934 | Wilson | 122/14 |

*Primary Examiner*—Edward G. Favors

*Attorney, Agent, or Firm*—Merriam, Marshall & Bicknell

[57] ABSTRACT

A multi-stage hot water heating apparatus provided with a burner utilizing combustible fuel. The apparatus has two or more tanks juxtaposed to each other and having a containment shell. One or more of said tanks having a hollow annular construction provided with a central flue opening. The tanks are arranged in conjunction with the containment shell to define a serial flow path for the passage of hot combustion gases to obtain maximum extraction of heat from the hot gases. The exhausted gases are vented through a stack connected through an imperforate coupler to the flue opening of one of the hollow annular tanks. Means are provided to space the tanks concentrically to each other to define a series of horizontal and annular plenums to form a substantial portion of the flow path.

9 Claims, 4 Drawing Figures

FIG. 1
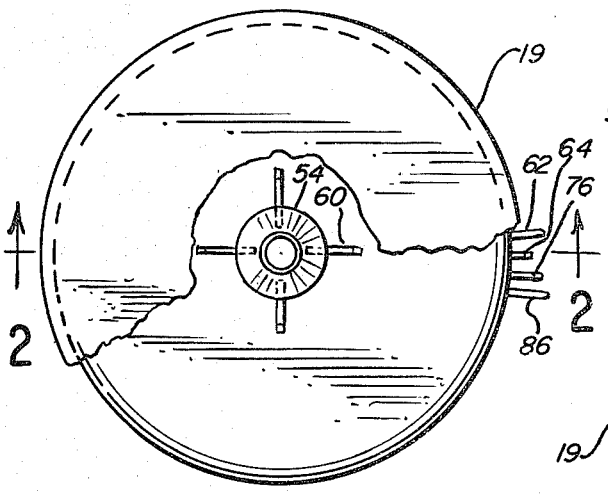
FIG. 2
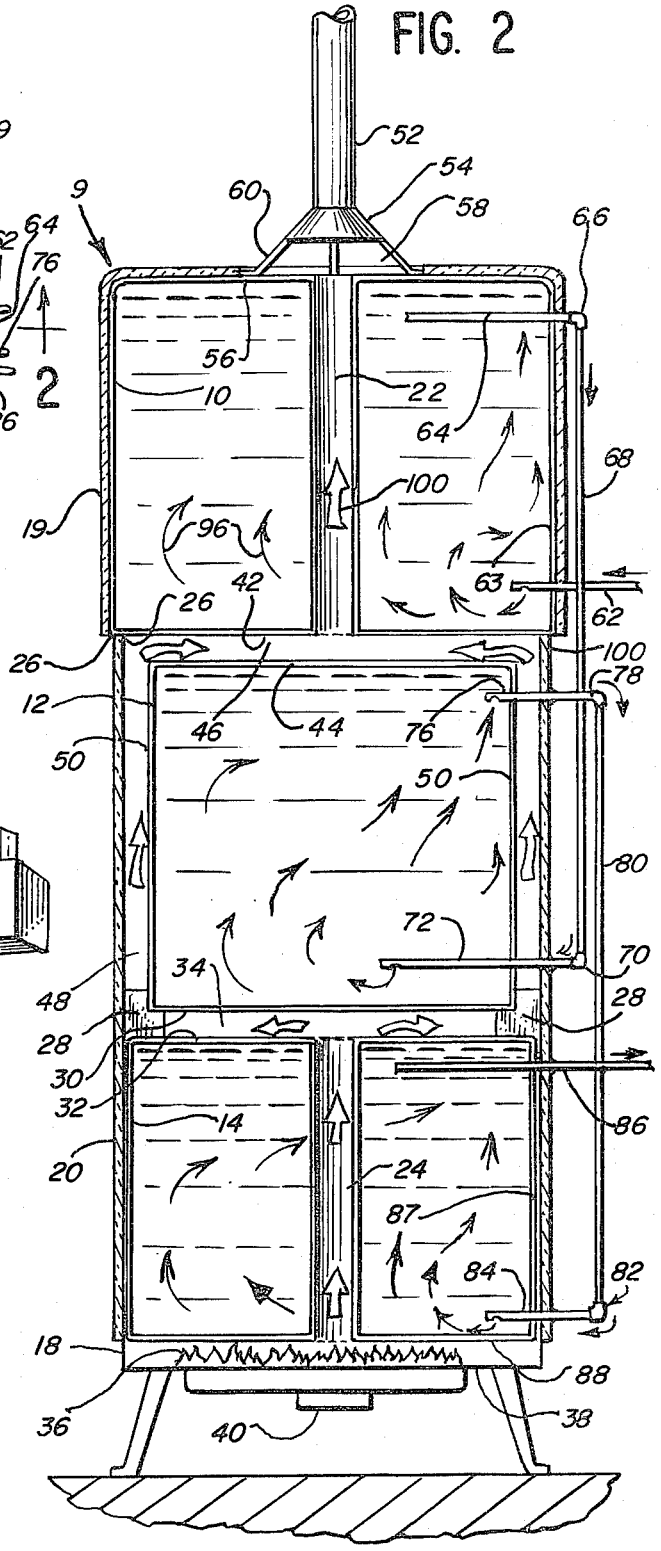
FIG. 2a
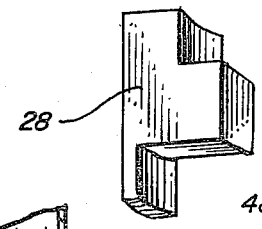
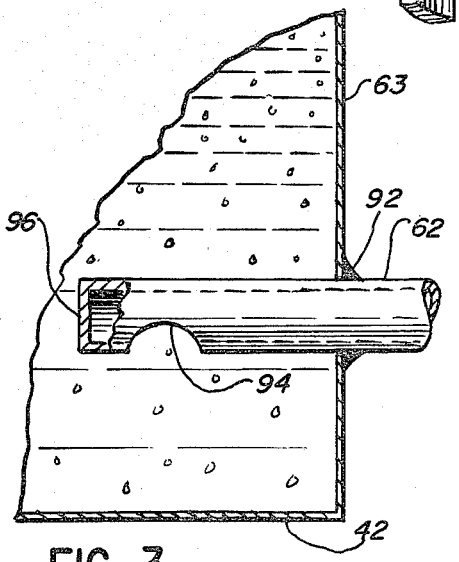
FIG. 3

MULTI-STAGE HOT WATER HEATING APPARATUS

BACKGROUND OF THE INVENTION

1. Field of Invention

This invention is concerned with apparatus for heating water and more particularly concerned with hot water tanks having multiple stages for heating water by means of combustible fuel.

2. Description of Prior Art

Apparatus for pre-warming incoming cold water prior to feeding it to a hot water tank heated by combustible fuel is well known. The pre-warming or pre-heating of the incoming cold water takes place in a separate tank, usually in the same location, as the hot water tank. The pre-warming is obtained from the ambient temperature air surrounding the separate tank. After aborbing some of the ambient temperature air, the water is passed on to the hot water tank employing usually an oil or gas burner to complete the heating of the water to a desired temperature.

SUMMARY OF THE INVENTION

A multi-stage apparatus for heating water utilizes at least two stages for absorbing heat from a source of combustion. The heat is absorbed through direct contact with the flame and through the contact with escaping flue gases. In particular, the apparatus comprises three separate stages as defined in three-tanks juxtaposed in respect to each other and surrounded by an insulating sleeve to obtain the maximum benefit of the combustion heat. Incoming cold water enters into an upper tank having a hollow annular construction having a central flue opening. Thereafter, the water flows into an intermediary tank disposed below the upper tank and then continues into a lower tank having a hollow annular construction and situated above a combustion chamber. The heated water exits from the lower tank for use at a proper destination. Each tank is provided with dispersing means for directing incoming water toward the bottom of the respective tank. Means are provided for properly fastening the intermediary tank with respect to the lower tank to provide an uniform annular plenum concentric to and surrounding the intermediary tank. The construction of the tanks and their disposition to each other is such as to eliminate the use of a flash back device at a stack connection, which device is used to minimize flame-out in the event of a down-draft.

BRIEF DESCRIPTION OF THE DRAWINGS

The invention will now be described in reference to the accompanying drawings, wherein;

FIG. 1 is a plan view of a multi-stage hot water heating apparatus;

FIG. 2 is a cross-sectional view of a tank taken along lines 2—2 of FIG. 1;

FIG. 2*a* is a perspective view of a spacer for positioning an intermediary tank with respect to a lower tank as shown in FIG. 2; and FIG. 3 is a partial cross-sectional view of a tank provided with a water inlet diffuser or diverter for directing incoming water toward the tank bottom.

DESCRIPTION OF THE PREFERRED EMBODIMENT

The preferred embodiment of the hot water heating apparatus 9 comprises two or more separate tanks, such as upper tank 10, an intermediary tank 12 and lower tank 14 juxtaposed in vertical position above each other. The upper tank 10 is surrounded by an insulating blanket 19. The intermediary and lower tanks 12 and 14, respectively are disposed in a containment shell 18 which is surrounded by an insulating blanket 20. The upper and the lower tanks have a hollow annular construction provided with flue openings 22 and 24, respectively, providing flow passages or a path for the escape of the combustion gases. The upper tank 10 is disposed atop the containment shell 18 in a gas-tight relationship which can be obtained by welding at a juncture point 26 or by placement of a concentric collar or band (not shown) which will span completely around the juncture point 26. The upper tank 10 is exteriorly surrounded by an insulating blanket 19. Blankets 19 and 20 may be integrally formed.

The intermediary tank 12 is concentrically disposed with respect to the shell 18 and the lower tank 14 by means of 3 or 4 spacers 28 which position the bottom 30 of the intermediary tank a predetermined distance from the top 32 of the lower tank 14. The spacers 28 not only define proper positioning for the intermediary tank 12 but also establish a plenum 34 for the passage of combustion gases as they leave the flue opening 24. The details of the spacer 28 construction are shown in FIG. 2*a*.

The lower tank 14 is fastened by any appropriate means such as welding within the shell 18, a predetermined distance above a fuel burner 36 installed at a bottom 38 of the shell 18. To obtain a proper combustion of the fuel, the bottom 38 has an air inlet 40.

The bottom 42 of the upper tank 10 and the top 44 of the intermediary tank 12 define a plenum 46 for the passage of combustion gases rising upwardly in an annular plenum 48 defined between the shell 18 and the vertical wall 50 of the intermediary tank 14.

The combustion gases, after exiting from the flue opening 22 are channeled into a stack 52 by a conventional perforate coupler 54 which has air induction openings 58 between feet 60 and is secured to a top 56 of the upper tank 10. Thereafter, the gases are dissipated to the outside atmosphere. As is well known, the perforate coupler 54 is used to prevent a flame-out of the flame at the burner 36 in case of a severe down-draft. The use of the perforate coupler results in a certain amount of heat to be vented from the room in which the heating apparatus is located. The upward flow of the combustion gases out of the flue opening 22 induces some of the room ambient air to be drawn into the stack 52. This loss can be eliminated by using an imperforate coupler which precludes communication between the flue opening 22 and the room ambient air. In other words, the imperforate coupler would have a solid truncated cone construction instead of having the openings 58 defined by the feet 60.

The elimination of the perforate coupler 54 is possible because of the unusual construction and arrangement possessed by the hot water heating apparatus 9, wherein any down-draft that occurs, is arrested and dissipated by the tortuous arrangement of the flue openings 22 and 24 in combination with the plenums 34, 46 and 48. Such arrangement inhibits the force of the down-drafts to such an extent that a flame-out at the burner 36 is substantially eliminated.

The upper tank 10 has an incoming cold water inlet in the form of a diverter nipple 62 which is secured and passes through a vertical wall 63 of the upper tank 10. The diverter nipple 62 directs the incoming cold water toward the bottom 42 of the tank. After the water is pre-warmed by the hot combustion gases flowing at the bottom 42 and in the flue opening 22, the pre-warmed water passes out through an elongate outgoing nipple 64 which is secured to the vertical wall 63 and is coupled by an elbow 66 to a pipe 68 which is coupled at its other end by an elbow 70 to an elongate diverter nipple 72 which passes through and is secured to a vertical wall 50 of the intermediary tank 12. The diverter nipple 72 extends toward the center of the intermediary tank 12 and directs the incoming pre-warmed water toward the bottom 30 which is heated by the hot combustion gases flowing through the plenum 34. Additional heat is absorbed by the intermediary tank 12 from the hot combustion gases flowing through the annular plenum 48.

After further pre-warming, the water exits through an outgoing nipple 76 passing through and secured to the vertical wall 50. The nipple 76 is coupled by an elbow 78 to a pipe 80 which, at its other, is coupled by an elbow 82 to a diverter nipple 84 passing through and secured to a vertical wall 87 of the lower tank 14. The diverter nipple 84 directs the incoming pre-warmed water toward a bottom 88 of the lower tank 14, which is heated by the flames present at the burner 36. Additional heat is absorbed by the water in the lower tank 14 from the hot exhaust gases flowing through the flue opening 24. After reaching its utmost temperature, the hot water in the lower tank 14 exits through an outgoing nipple 86 extending through and secured to a vertical wall 87. The nipple 86 extends through the lower tank 14 in close proximity to the flue opening 24. The nipple 86 defines a hot water outlet for the apparatus 9.

All of the nipples passing through the vertical walls of the respective tanks are secured by well known means, for example, as by welding. Whereas the nipples 64, 76 and 86 comprise pipes of various short lengths, as illustrated, the diverter nipples 62, 72 and 84 possess a particular construction which is responsible for directing the incoming water toward the bottoms of the respective tanks. This particular construction is illustrated in FIG. 3, wherein one of the diverter nipples, such as 62, is secured by weld 92 to the vertical wall 63. The diverter nipple 62 has an opening 94 which directs the incoming water toward the bottom 42. An end 96 of the nipple 62 is closed, as shown. This type of diverter nipple can be readily inserted through an opening in the vertical wall of the tank and welded, thereby reducing production costs. The outgoing nipples 64, 76 and 86 are similarly welded to the vertical walls of the respective tanks.

As shown, in FIG. 2, incoming cold water passes through the nipple 62 into the interior of the upper tank 10 and is directed toward the bottom 42. The circulation of the incoming water in the tank 10, as well as tanks 12 and 14, is shown by line arrows 96. The cold water absorbs the heat from the hot combustion gases, the flow of which is indicated by flat arrows 100. After being pre-warmed, the water flows out through the outgoing nipple 64 and is directed through the diverter nipple 72 into the interior of the intermediary tank 12. After further pre-warming, the water leaves the intermediary tank 12 through the outgoing nipple 76 and is directed through the diverter nipple 84 into the interior of the lower tank 14. In tank 14, which defines the final stage of heating, the water reaches its highest temperature before it passes out through the nipple 86 to its destination of use.

As described, the heating apparatus 9 comprises three stages of heating incoming cold water, each stage contributing in its part to the absorption of the heat generated by the burner 36. It is possible, of course, to employ only two stages for heating the incoming cold water. This would be done by eliminating the lower tank 14 and placing the burner 36 under the bottom 30 of the intermediary tank 12. The hot water would then pass through the outgoing nipple 76 to its destination of use.

In a typical construction of the heating apparatus 9, the tanks 10, 12 and 14 were made from metal, such as steel, having a wall thickness of 0.125 inch. The upper and the intermediary tanks 10 and 12 are about 20 inches high and each as a capacity of about 30 gallons. The lower tank is about 14 inches high and has a capacity of about 21 gallons.

The flue openings 22 and 24 have a 4 inch diameter. The annular plenum 48 comprises an annular space of about ½ inch between the vertical wall 50 of the intermediary tank 12 and the shell 18. The spacers 28 are preferrably affixed to the intermediary tank 12 as by welding, in order to facilitate the mounting of the intermediary tank in a concentric relationship atop the lower tank 14. The interior of all the tanks may be glass lined in a conventional manner.

Although the nipples, such as 62 and 64 are shown extending through the vertical walls of the respective tanks, it is obvious that the nipples may extend through other portions of the tank structures.

The embodiment shown in FIG. 2 has a round intermediary tank 12 positioned between annular upper and lower tanks 10 and 14. However, it is apparent that the round tank can be positioned over the burner 36 and the annular tank 14 can be positioned immediately above and spaced from the newly positioned round tank 12 so that the flue opening 24 would line up with the flue opening 22 in the upper tank 10. To improve the heat extraction from the combustion gases in such a rearrangement, the flue opening 24 in the tank 14, in its new position, could be off-set with respect to the flue opening 22 in the tank 10. Also, the diameter of the newly positioned tank 14 would be reduced so as to provide an annular plenum between the tank 14 and the containment shell 18, such as the annular plenum 48.

Although a diverting means such as diverting nipples have been specifically disclosed, it is possible to use other forms of diversion devices, for example, such as baffles for directing the incoming water toward the bottoms of the respective tanks.

From the foregoing description of the preferred embodiment of the invention, it is apparent that various modifications may be made without departing from the spirit of the invention and, therefore, it should be understood that this invention should not be limited to the exact forms and constructions shown and described.

What is claimed is:

1. A hot water heater comprising three tanks arranged vertically in a casing wherein the upper and lower tanks have a center flue disposed vertically therethrough, the middle tank being imperforate and spaced from the walls of the casing forming an annular flue with the walls of said casing, burner means positioned adjacent the bottom of said lower tank and communicating with the center flue of said lower tank, an exhaust stack positioned on said casing and communicating with the center flue of said upper tank whereby the gases of combustion flow in a serpentine path from the burner to the exhaust stack.

2. A water heater according to claim 1, having fluid flow means connecting the upper tank to the middle tank and the middle tank to the lower tank, a cold water supply inlet line communicating with the bottom of the upper tank and a hot water supply outlet line communicating with the top of the lower tank.

3. A hot water heater according to claim 1, wherein said middle tank is of cylindrical construction.

4. A hot water heater according to claim 3, wherein said middle tank is concentrically positioned with respect to said upper and lower tanks.

5. A hot water heater according to claim 1, wherein each of said tanks is provided with a diverter, whereby said diverter directs incoming water to each of said tanks toward the bottom of the respective tank.

6. A hot water heater according to claim 1, including a spacer for mounting said middle tank concentrically with respect to said upper and lower tanks, said spacer defining a plenum between the bottom of said middle tank and the top of said lower tank for conducting gases of combustion therethrough, wherein said plenum forms a portion of said serpentine path.

7. A hot water heater according to claim 1, including an insulating thermal blanket enveloping said casing.

8. A hot water heater according to claim 2, wherein each of said tanks includes a diverter nipple for diverting incoming water toward the bottom of the respective tank, each diverter nipple comprising a straight section of a pipe passing through a vertical wall of a tank and secured thereto, the free end of said pipe being closed, and an opening adjacent said closed end and facing the bottom of said tank.

9. A hot water heater according to claim 1, wherein said casing includes an open-top containment shell containing said middle tank and said lower tank, with said upper tank disposed atop the containment shell and further including means for sealing said upper tank to said containment shell so that the center flue of said upper tank is in communication with the gases of combustion flow exiting from said middle tank annular flue.

* * * * *